US005490957A

United States Patent [19]

Lasko et al.

[11] Patent Number: 5,490,957

[45] Date of Patent: Feb. 13, 1996

[54] PORTABLE HUMIDIFIER

[76] Inventors: William E. Lasko; Charles Litvin; Kurt F. Hafeken; Leo Gonzales, all c/o Lasko Metal Products, Inc., P.O. Box 891, W. Chester, Pa. 19380

[21] Appl. No.: 417,109

[22] Filed: Apr. 5, 1995

Related U.S. Application Data

[63] Continuation-in-part of Ser. No. 313,781, Sep. 28, 1994.

[51] Int. Cl.[6] ..... B01F 3/04

[52] U.S. Cl. ..... 261/29; 261/106

[58] Field of Search ..... 261/29, 106

[56] References Cited

U.S. PATENT DOCUMENTS

| | | | |
|---|---|---|---|
| 2,752,134 | 6/1956 | Paulus | 261/29 |
| 2,769,620 | 11/1956 | Davison | 261/29 |
| 2,961,226 | 11/1960 | Goettl | 261/29 |
| 4,562,016 | 12/1985 | Colliver | 261/29 |
| 4,588,425 | 5/1986 | Usry et al. | 261/142 |
| 4,921,642 | 5/1990 | La Torraca | 261/66 |
| 4,967,728 | 11/1990 | Dueck | 261/DIG. 34 |
| 5,143,656 | 9/1992 | Marino et al. | 261/26 |
| 5,250,232 | 10/1993 | Pepper et al. | 261/107 |

FOREIGN PATENT DOCUMENTS

| | | | |
|---|---|---|---|
| 3305390 | 8/1984 | Germany | 261/29 |
| 8200083 | 9/1982 | Netherlands | 261/29 |

*Primary Examiner*—Tim R. Miles
*Attorney, Agent, or Firm*—Zachary T. Wobensmith, III

[57] ABSTRACT

A portable humidifier that provides a visual indication of the internal water flow, with a motor for pumping water so that it provides a visible show, flows over at least one vertical filter, which provides uniform increased humidity for the filter area, which motor is also attached to a fan blade to disperse moisture into the environment.

4 Claims, 2 Drawing Sheets

PORTABLE HUMIDIFIER

CROSS REFERENCE TO RELATED APPLICATIONS

This application is a continuation in part of our prior application Ser. No. 08/313,781, filed Sep. 28, 1994 titled "HUMIDIFIER".

BACKGROUND OF THE INVENTION

1. Field of the Invention

A portable humidifier of the type which pumps water over a vertical honeycomb filter, provides a visual indication of water flow, and has a dual use motor to pump water to the filter, and to move moisture laden air therefrom by forced air flow.

2. DESCRIPTION OF THE PRIOR ART

With the ever increasing advances in the insulation of buildings and improvements in air flow for heating and cooling, the control of humidity in such buildings has become increasingly important. Humidifiers have been used in the air circulation systems, but do not always provide the desired level of humidification in all areas of the building. Portable humidifiers, which add moisture to the building environment at selected locations, can by varying the supplied moisture, increase the comfort level of persons in the building environment, and reduce the total energy requirement.

The prior art portable humidifiers usually relied on a wick-like structure which was in contact with a supply of water. The wick absorbed water by capillary action, and air forced through the filter picked up this moisture and carried it into the building environment.

The efficiency of this device leaves a lot to be desired. It limits the amount of moisture to the absorption rate by capillary action of the filter material. In terms of increasing the comfort level of the environment, many persons would like a visual indication that the humidifier is in operation. Some devices have ribbons placed in the air output stream to indicate operation, but this addition does not indicate whether any moisture is being supplied to the environment. Without a visual indication of the presence of water, the humidifier can go dry or become ineffective without the user becoming aware. In addition, standing water with which the wick is in contact often becomes stagnant, and picks up mold and bacteria. Also, minerals in the stagnant water can impede the capillary action of the wick and cause it to become ineffective.

The portable humidifier of the invention provides a visual confirmation to an observer of the volume of the water flowing through the unit. The increased volume of water in the filter allows for increased moisture transfer to the air, and increased humidity in the living environment. The constant circulation of water by the pump through the filters, and within the water reservoir obviates the problems associated with stagnant water in the filter of wicking type humidifiers, and provides other advantages.

SUMMARY OF THE INVENTION

It has now been found that a portable humidifier is available that provides a visual indication of the water flow, which is highly efficient, promotes a cleaner environment with filters that are not in standing water, and includes a dual use motor that both pumps the water and moves the moisture laden air to provide increased humidity to a building environment.

The principal object of the invention is to provide a portable humidifier that provides a visual indication of water flow.

A further object of the invention is to provide a portable humidifier that constantly circulates water through a filter as it provides moisture to the environment, and which eliminates stagnant water.

A further object of the invention is to provide a portable humidifier that is more efficient than previously available humidifiers.

A further object of the invention is to provide a portable humidifier that includes a dual use motor which both pumps the water and moves moisture laden air.

A further object of the invention is to provide a portable humidifier that has vertically oriented, easily removable honeycomb filters which are not located in standing water.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numbers refer to like parts throughout the several views.

DESCRIPTION OF THE PREFERRED EMBODIMENT

When referring to the preferred embodiments, certain terminology will be utilized for the sake of clarity. Use of such terminology is intended to encompass not only the described embodiment, but also technical equivalents which operate and function in substantially the same way to bring about the same result.

Figure 1:
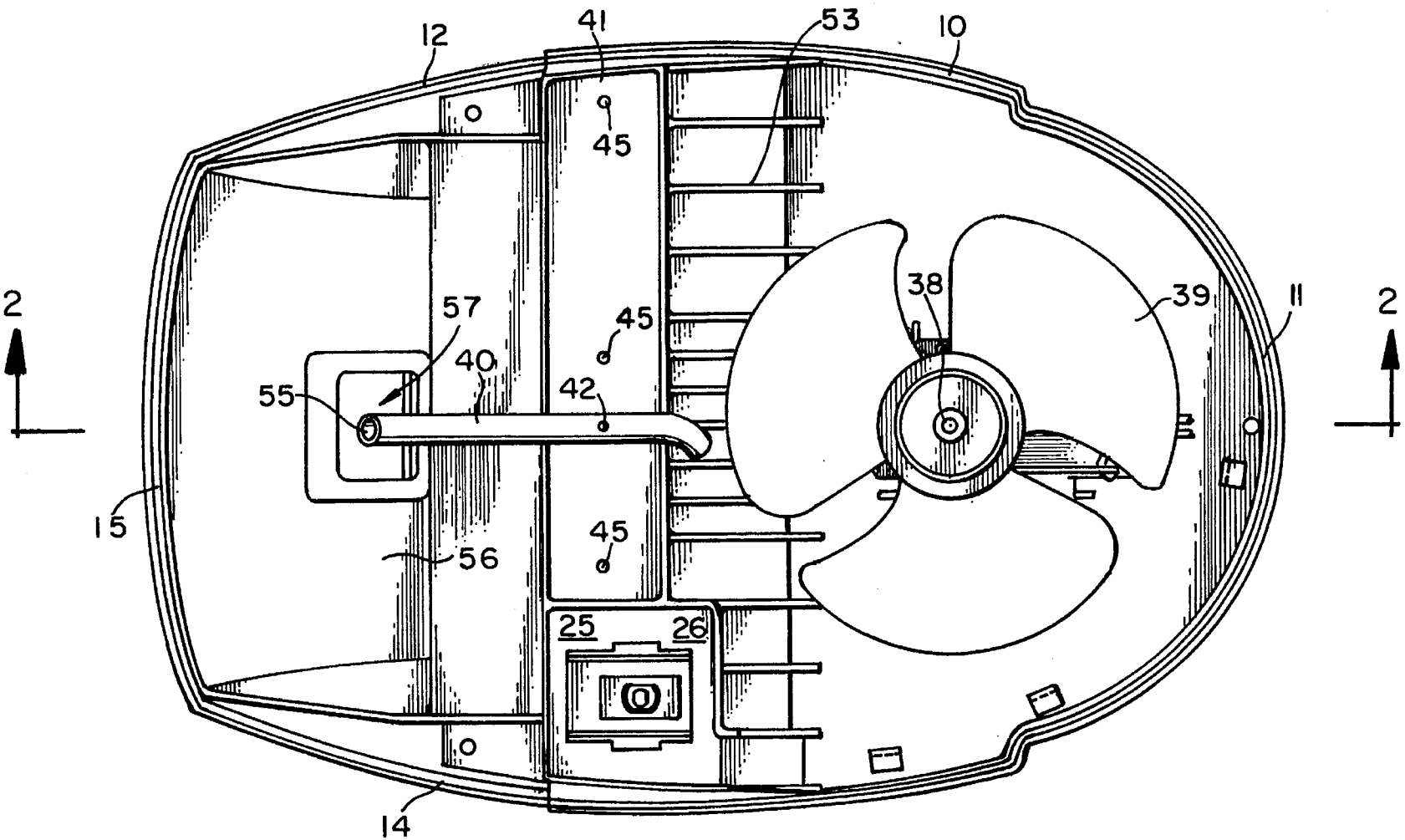
FIG. 1 is a top plan view, partially cut away, which illustrates the humidifier of the invention.
Figure 2:
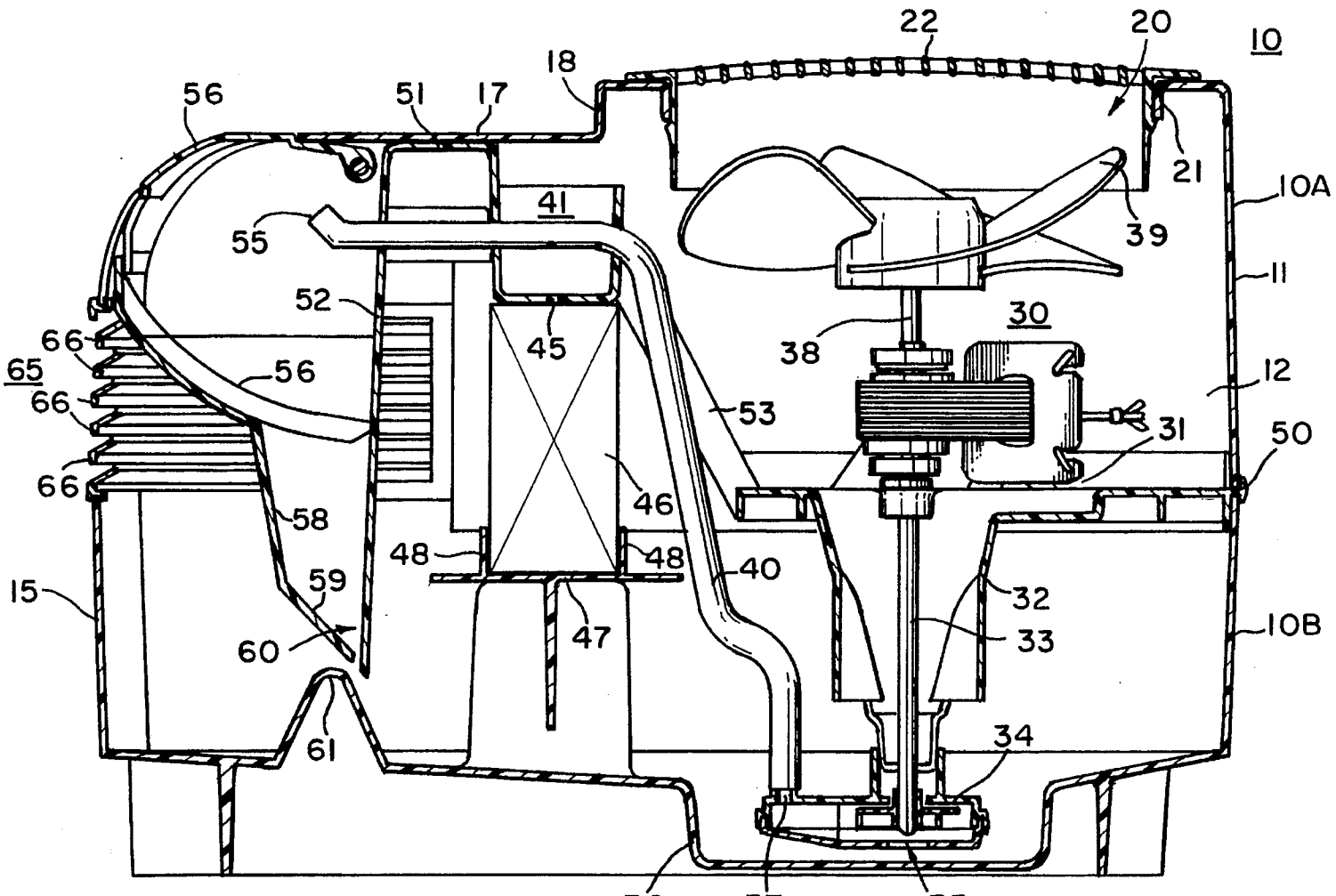
FIG. 2 is a vertical sectional view taken approximately on the line 2—2 of FIG. 1.

Referring now more particularly to FIGS. 1 and 2 of the drawings, the humidifier as illustrated is of semi-circular shape, with an outer housing 10, which has a front wall 11, a right side wall 12, and a left side wall 14. The right and left side walls 12 and 14 extend rearwardly to and meet a rear wall 15 also of semicircular shape.

A top wall 17 is provided which extends to and joins front wall 11, side walls 12 and 14, has a step down portion 18, and terminates at rear wall 15.

The top wall 17 is provided with a round opening 20 for air and moisture flow, with a down turned lip 21, which opening receives a circular exhaust grill 22.

The outer housing 10 is preferably formed of molded plastic of well known type.

The housing 10 contains an electric motor 30 of well known type mounted to shelf 31 under and in line with opening 20, with a funnel shaped housing 32 extending downwardly therefrom.

The top wall 17 also mounts an on/off switch 25, and a high/low speed fan switch 26 in series therewith, which are connected to motor 30 in well known manner (not shown).

The motor 30 has a bottom output shaft 33 extending therefrom which is connected to a pump 34 mounted to housing 32, and which pump has a water inlet 35 above the bottom wall 36 of the housing 10. The pump 34 also has a water outlet 37.

The motor 30 has a top output shaft 38 extending therefrom, with a fan blade 39 of well known type attached thereto in well known manner, and which moves moisture laden air out through the exhaust grill 22 into a building (not shown).

The pump water outlet 37 has a hose 40 connected thereto which extends upwardly and across a water trough 41.

The hose 40 over trough 41 is provided with a trough supply nozzle 42 to supply water to trough 41. The trough 41 is of rectangular shape, extends from side wall 12 to side wall 14, and is provided with a plurality of filter supply drip holes 45.

A filter 46 is provided of rectangular configuration, vertically oriented and mounted to filter support 47, which extends transversely across the housing 10, with vertical walls 48 which extend upwardly from support 47 on each side of filter 46 protecting it from the water (not shown) in the bottom of housing 10, which at full water level is below the tops of walls 48.

The filters are of expanded aluminum/paper honeycomb construction, which provides approximately 40% more humidity for its surface area than other conventional filters.

The housing 10 is of two piece construction 10A and 10B, with a connector band 50, which extends around the perimeter of the housing 10 to retain the housing pieces 10A and 10B together, but permits housing piece 10A to be removed for access, and to remove filter 46. The housing piece 10B forms a water reservoir which holds a supply of water (not shown).

The trough 41 has a horizontal wall 51 attached thereto, which extends rearwardly to a vertical wall 52 through which the hose 40 extends, and a fan safety grill 53 is provided in front of filter 46.

The hose 40 has a water show nozzle 55 on the end thereof for water discharge.

The rear wall 15 has a clear water show lens 56, which permits viewing water (not shown) as it is discharged from nozzle 55.

The water discharged from nozzle 55 falls onto a curved bottom wall 56, is discharged through opening 57, and against wall 58 which extends from walls 15 and 59, attached to wall 58, forming a water return chute 60 with wall 52. The bottom wall 36 has a raised step 61 in back of wall 59 to divert water from chute 60 towards the front of housing 10.

The rear wall 15 and side walls 12 and 14 below lens 56 have an air intake grill 65 therein, which permits air flow to and through filter 40, but which grill is provided with baffles 66 to restrict water in housing 10 from splashing out.

In operation, pump switches 25 and 26 are activated and pump output shafts 33 and 38 rotate, causing water to be drawn in through pump inlet 35, and forced out outlet 37 through hose 40 to water trough 41, where a portion of it flows out trough supply nozzle 42 into trough 41, and thence out filter supply drip holes 45 in trough 41 onto filter 46. The water flow is visible through lens 56 as it flows out water show nozzle 55, from which it flows out opening 57 in wall 56 and through water return chute 60 into housing piece 10B for reuse.

The output shaft 38 rotates fan blade 39 drawing air in through intake grill 65, and through filter 40 where it picks up moisture, and then flows out through exhaust grill 22 into the building.

It is thus apparent that a portable humidifier has been provided with which the objects of the invention are achieved.

We claim:

1. A portable humidifier for providing moisture laden air which comprises an outer housing having a front wall, side walls, a top and bottom wall, and a rear wall, said top wall having an air outlet opening with a grill therein, said side walls and said rear wall having an air inlet grill opening, a supply of water in said housing, motor means carried in said housing with output shafts at the top and bottom of said motor means, water pump means connected to said bottom output shaft, said water pump means having a water inlet in communication with said water in said housing and a water outlet, hose means in communication with said pump water outlet, a water trough below said top wall extending between said side walls, a plurality of filter supply drip holes in said trough, said hose means extending across said trough, and having a water supply nozzle to supply water thereto, at least one vertically oriented filter means below said openings in said water trough to receive water therefrom, and which is above the water on said bottom housing wall, said hose having a water show nozzle on the end thereof, viewing means in said rear wall to permit viewing of water discharged from said water show nozzle, and fan blade means connected to said motor top output shaft to cause air to flow in through said air inlet grill opening, through said water filter means, and to cause moisture laden air to flow out through said air outlet opening grill.

2. A portable humidifier as defined in claim 1 in which said filter means is of an expanded aluminum/paper honeycomb construction.

3. A portable humidifier as defined in claim 1 in which said outer housing is of two piece construction.

4. A portable humidifier as defined in claim 1 in which said viewing means is a lens.

* * * * *